US006090451A

United States Patent [19]

Barth et al.

[11] Patent Number: 6,090,451

[45] Date of Patent: Jul. 18, 2000

[54] WINDOW FILM EDGE SEALING METHOD

[75] Inventors: Steven A. Barth; Steven L. Debusk, both of Martinsville; Joseph Richard, Collinsville, all of Va.

[73] Assignee: CPFfilms, Inc., Martinsville, Va.

[21] Appl. No.: 09/274,115

[22] Filed: Mar. 23, 1999

[51] Int. Cl.[7] ..... B05D 1/00; B05D 1/26

[52] U.S. Cl. ..... 427/429; 427/284; 401/23; 401/138

[58] Field of Search ..... 427/284, 286, 427/287, 429; 401/202, 138, 192, 213, 235, 195, 16, 23, 193, 196, 123

[56] References Cited

U.S. PATENT DOCUMENTS

| | | | |
|---|---|---|---|
| 4,046,951 | 9/1977 | Stefanik . | |
| 4,050,892 | 9/1977 | Jilla . | |
| 4,055,971 | 11/1977 | Hermes . | |
| 4,408,021 | 10/1983 | Penn . | |
| 4,429,005 | 1/1984 | Penn . | |
| 4,557,980 | 12/1985 | Hodnett, III . | |
| 4,565,719 | 1/1986 | Phillips et al. . | |
| 4,634,637 | 1/1987 | Oliver et al. . | |
| 4,640,868 | 2/1987 | Penn . | |
| 4,652,163 | 3/1987 | Karliner et al. | 401/195 |
| 4,797,317 | 1/1989 | Oliver et al. . | |
| 4,960,631 | 10/1990 | Walters et al. . | |
| 5,122,403 | 6/1992 | Roginski et al. . | |
| 5,320,893 | 6/1994 | Floyd . | |
| 5,340,661 | 8/1994 | Van Havenbergh et al. . | |
| 5,702,759 | 12/1997 | White et al. | 427/142 |
| 5,725,937 | 3/1998 | Johnston . | |

*Primary Examiner*—Diana Dudash
*Assistant Examiner*—Jennifer Kolb
*Attorney, Agent, or Firm*—Nixon & Vanderhye P.C.

[57] ABSTRACT

Window film (e.g., solar film) is edge-sealed by moving a porous applicator tip saturated with liquid sealant in wiping contact along an edge of the window film to be sealed so as to transfer a portion of the liquid sealant from the saturated applicator tip to the window film edge. Thereafter, the liquid sealant is allowed to dry so that a residue of the sealant (e.g., most preferably a solvated plastics material) remains as a transparent layer sealing the space between the window film edge and the adjacent window glass frame. Most preferably, a kit is provided which includes a pen-like applicator and a container which contains a quantity of liquid sealant. The applicator is provided with the porous applicator tip at one end in fluid communication with a barrel defining an interior reservoir space. The reservoir space may thus be filled with a quantity of liquid sealant which is brought into fluid communication with the reservoir space so as to allow the liquid sealant to flow into the applicator tip and thereby saturate the same.

8 Claims, 3 Drawing Sheets

WINDOW FILM EDGE SEALING METHOD

FIELD OF THE INVENTION

The present invention relates generally to the edge-sealing of window film materials. More specifically, the present invention relates to kits and methods whereby transparent window films laminated to glass windows may be edge sealed to prevent film corrosion and/or degradation.

BACKGROUND AND SUMMARY OF THE INVENTION

Transparent window films are adhered to glass window surfaces so as to reduce the amount of near infra-red, ultra-violet and/or visible radiation entering interior building space. Films are also provided so as to maintain heat in the interior space—that is, to reduce heat radiation loss through the window. The window films thus assist to minimize loads on the heating, ventilating and air conditioning (HVAC) system which services the building. Lower HVAC loads thereby translate into lower costs of hating or cooling the interior building space.

Such "solar control films" can have a variety of film structures. For example, one common type of solar film is a laminate structure having a base layer (e.g., a transparent polyester sheet, such as polyethylene terephthalate sheet) having a relatively thin, transparent solar reflective metallized deposit thereon. A protective layer (e.g., polyethylene terephthalate) may then be applied over the solar reflective layer. See, for example, U.S. Pat. No. 4,634,637, the entire content of which is expressly incorporated hereinto by reference.

Solar films are typically adhered physically to a surface of a glass window using a suitable transparent adhesive, such as those disclosed in U.S. Pat. Nos. 4,429,005 and 4,408,021, the entire content of each patent being incorporated expressly hereinto by reference. In general, the window films are cut to substantially cover the entire window glass area, except for a small border region between the edges of the film and the window frame (typically on the order of between about 1/16 inch to about 1/8 inch). In order to protect the metallized deposits or layers of the solar film from the degradative effects of window cleaners and other ambient atmospheric conditions (e.g., moisture and salt), it may be necessary to seal the edges of the window film with a suitable sealant. In this way, the sealant substantially minimizes (and most preferably prevents) degradative chemical attack on the individual metallized deposits or layers of the solar film so as to minimize (or prevent entirely) oxidation or corrosion which, in turn, allows to film to retain its appearance over its useful life.

Edge sealing of window films adhered to glass window surfaces can, however, be problematic. For example, in order to enhance the visual appearance of the finished edge-sealed solar film, the sealant should be transparent. Furthermore, only a relatively thin layer of the edge sealant should be applied so as to maintain its transparency. The edge sealant should not be too viscous as otherwise application would be difficult, while relatively non-viscous edge sealants tend to run along the edge of the glass preventing an adequate edge seal from being formed and potentially marring the visual appearance of the finished window.

Conventional edge sealants are applied in a number of ways, none of which is particularly effective. For example, edge sealants have been applied directly from a nozzle or spout of a container. These techniques, and the typical edge sealant employed, render it quite difficult to apply a thin, transparent seal along the entire edge of the window film which does not give rise to visual imperfections. The art therefore has clearly needed improved techniques to edge-seal window films, and it is toward providing such improved techniques that the present invention is directed.

Broadly, the present invention is directed toward kits and methods whereby transparent edge seals may be applied to window films adhered to window glass surfaces. More specifically, according to the present invention, window film (e.g., solar film) is edge-sealed by moving a porous applicator tip saturated with liquid sealant in wiping contact along an edge of the window film to be sealed so as to transfer a portion of the liquid sealant from the saturated applicator tip to the window film edge. Thereafter, the liquid sealant is allowed to dry so that a residue of the sealant (e.g., most preferably a solvated plastics material) remains as a transparent layer sealing the space between the window film edge and the adjacent window glass frame. Most preferably, one form of the present invention is a kit which includes a pen-like applicator and a container which contains a quantity of liquid sealant. The applicator is provided with the porous applicator tip at one end in fluid communication with a barrel defining an interior reservoir space. The reservoir space may thus be filled with a quantity of liquid sealant which is brought into fluid communication with the reservoir space so as to allow the liquid sealant to flow into the applicator tip and thereby saturate the same.

Further aspects and advantages of this invention will become more clear after careful consideration is given to the following detailed description of the preferred exemplary embodiments thereof.

BRIEF DESCRIPTION OF THE ACCOMPANYING DRAWINGS

Reference will hereinafter be made to the accompanying drawing FIGURES, wherein like reference numerals depict like structural elements and/or steps, and wherein.

DETAILED DESCRIPTION OF THE INVENTION

Figure 1:
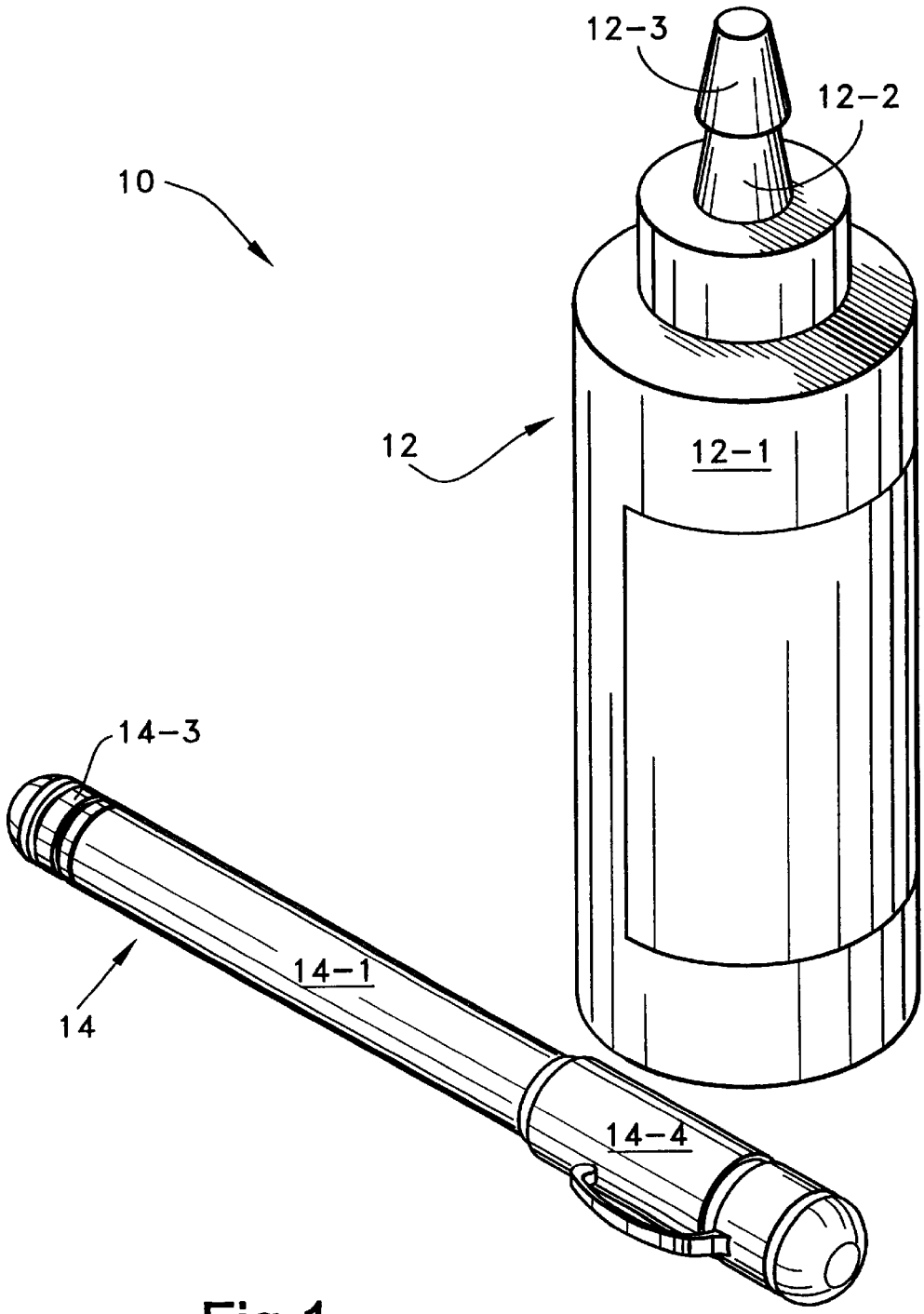
FIG. 1 is a perspective view showing the window film edge-sealing kit components in accordance with the present invention.

The window film edge-sealing kit 10 is shown in accompanying FIG. 1 as essentially comprising a container 12 of liquid edge sealant and a pen-like applicator 14. The container 12 can be of any suitable form and/or variety provided that it is compatible with the liquid sealant material contained therewithin. The exemplary container 12 depicted in FIG. 1 is a bottle 12-1 formed, for example, of a chemically resistant metal or plastics material, having a conically-shaped discharge tip 12-2 which may be sealed by a conformably shaped cap 12-3. Most preferably, the discharge tip 12-2 is sized and configured to allow for relatively easy transfer of the liquid sealant material within the container 12 to the applicator 14.

Figure 2:
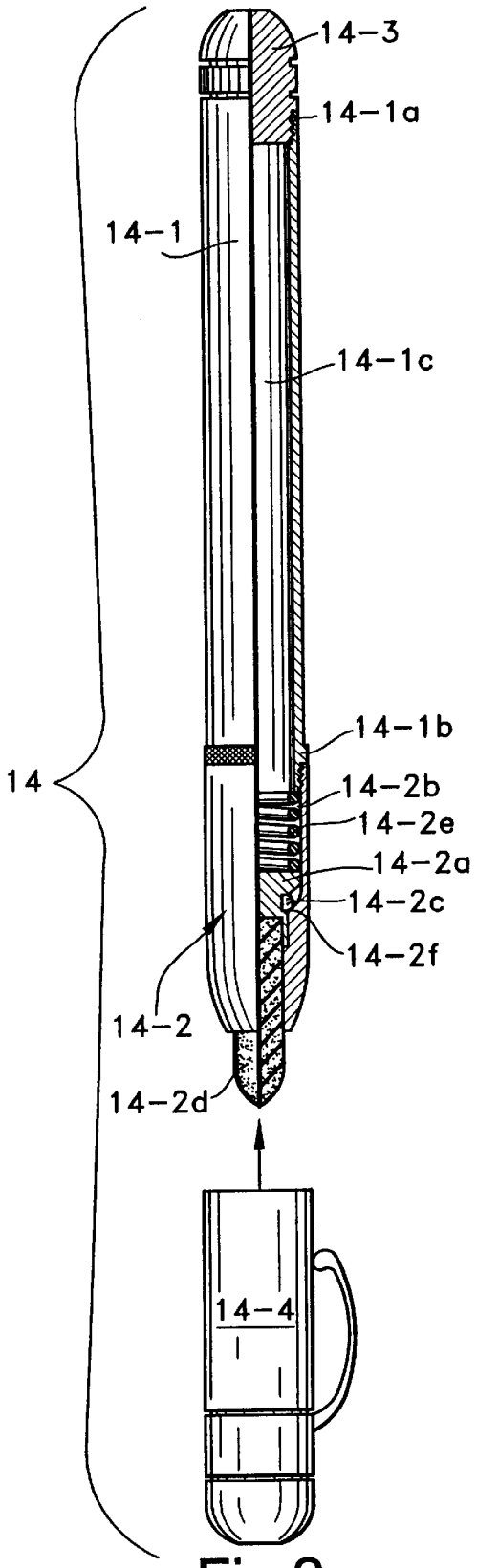
FIG. 2 is an elevation view, partly sectioned, showing a particularly preferred window sealant applicator employed in the method and kit of the present invention.

As is perhaps more clearly depicted in FIG. 2, the applicator 14 includes an upper reservoir barrel 14-1 in fluid communication with a lower applicator assembly housing 14-2. The uppermost open end 14-1*a* of the barrel 14-1 is threadably coupled to, and thus plugged by, an end-cap 14-3 while the lowermost end 14-1*b* of the barrel 14-1 is threadably coupled to the lower applicator assembly housing 14-2. A generally cylindrical reservoir space 14-1*c* is thus defined by the barrel 14-1 between its uppermost and lowermost open ends 14-1*a* and 14-1*b*, respectively.

The applicator assembly housing 14-2 includes a plug member 14-2*a* which is axially moveable within the recess 14-2*b* of the upper end of the applicator assembly 14-2. The plug member 14-2*a* carries an annular seal ring 14-2*c* and an outwardly projecting applicator tip 14-2*d*. The seal ring must be chemically compatible with the liquid edge sealant employed, particularly the solvents employed. Thus, for the preferred edge sealant discussed in greater detail below, the seal ring 14-2*c* is most preferably formed of an ethylene propylene rubber (e.g., EPM or EPDM). A compression spring 14-2*e* is positioned between the lowermost end 14-1*b* of the barrel 14-1 and the plug member 14-2*a* so as to urge the seal ring 14-2*c* into sealing contact with an interior annular seat 14-2*f* of the housing 14-2.

The applicator tip 14-2*d* is most preferably a self-supporting, substantially rigid porous member which is capable of being saturated by the liquid sealant material. The applicator tip 14-2*d* may thus be formed of a porous natural or synthetic felt-like material (e.g., a non-woven fibrous material), a natural or synthetic open-celled porous foam material, or the like. The applicator tip 14-2*d* will thus protrude outwardly from the terminal end of the applicator assembly housing 14-2 as shown in FIG. 2. When the applicator tip 14-2*d* is thus pressed against a window surface during the sealant application process, the plug 14-2*a* will be moved responsively rearwardly within the recess 14-2*b* against the bias force of the spring 14-2*e* thereby unsealing the seal ring 14-2*c* and the seat 14-2*f*. As such, the liquid sealant within the reservoir space 14-1*c* within the barrel 14-1 is allowed to flow by gravity to the porous applicator tip 14-2*d* and thereby saturate the same. The liquid sealant material saturating the applicator tip 14-2*d* may therefore be transferred to the window surface by moving the applicator tip 14-2*d* in wiping contact therewith.

Since the sealant material contained within the barrel 14-1 will most typically contain an evaporative solvent, the applicator 14 is most preferably provided with a removable cap 14-4 so as to prevent the sealant material from hardening within the applicator tip 14-2*d*.

The most preferred applicator 14 for use in the present invention is the "Pro Master Refillable Marker" commercially available from Organic Products Inc. of Irving, Tex. Most preferably, the applicator tip 14-2*d* is the PM-3 domed-point tip, but the PM-8 chisel point tip may also be employed. The O-ring seals (not shown) employed in the applicator 14 should, of course, be chemically compatible with the particular edge sealant being used. In this regard, an the applicator 14 should have O-rings formed of ethylene propylene rubber (e.g., EPM or EPDM) when using the preferred solvated liquid polyester sealant discussed below.

Virtually any suitable liquid sealant can be employed in the practice of the present invention. Thus, the liquid sealant must be chemically compatible with the window glass, window frame structures and the particular window film whose edge is being sealed and must accomplish its intended window film edge-sealing functions when dried or cured. In this regard, the following criteria may be employed by those in this art when selecting a particular liquid sealant: (i) reduced corrosion of metallized film when subjected to ASTM B-117 Salt-Fog Exposure, (ii) non-corrosive/non-damaging to common window frame materials (e.g., wood, vinyl and aluminum), (iii) UV-resistant, (iv) resistant to ammonia and acetic acid to allow cleaning window with common household window cleaners containing ammonia or acetic acid without disturbing and/or destroying edge sealant, (v) excellent adhesion to glass, polyester, acrylic scratch resistant coatings used on conventional window films, uncoated and coated (e.g., polyurethane, shellac, oil or water-based paint coatings) wood, and uncoated and coated (e.g., oil or water-based paint coatings) aluminum, (vi) non-tacky after drying to prevent dust and dirt accumulation, (vii) drying within minutes, (viii) relatively clear after drying to minimize appearance of edge sealant, and (ix) non-clouding when exposed to high humidity.

Preferred edge sealants are those which include solvated polymeric materials. Thus, the sealant is solvated to an extent to provide the necessary flow properties to allow saturation of the applicator tip 14-2*d* and transfer to the window and film surface in a sufficient thickness to allow for edge-sealing without substantial running and/or dripping. According to the present invention, the liquid sealant should have a viscosity at a standard temperature (20° C.) such that a Gardner #2 Zahn cup is emptied in between about 20 to 30 seconds, and most preferably between about 23 to about 24 seconds. Within the preferred viscosity range, a continuous flow of sealant material will be supplied to the sealant tip 14-2*d* to the window surface being sealed if applied at a recommended application rate of 2 to 3 inches per second, and will avoid excessive running or slumping on the vertical window during application. The viscosity of the particular sealant material may thus be readily adjusted to within acceptable ranges by the addition of a suitable solvent.

One particularly preferred sealant material is a solvated polyester (i.e., a polyester dissolved in a suitable liquid organic solvent) which is more fully described in U.S. Pat. Nos. 4,429,005 and 4,408,021, the entire content of each patent being expressly incorporated hereinto by reference. These preferred edge sealant materials are available commercially from Morton International, Inc. of Chicago, Ill. under the tradename Adcote™. Particularly preferred are Adcote™ 89R1 or 89R3 materials conventionally used as adhesives for adhering window films to glass substrates. According to the present invention, the commercially obtained sealant material contains, by weight, approximately 47% 2-butanone/methyl ethyl ketone (MEK), 20% toluene, with the balance being a polyester resin. This commercially supplied material is then reformulated by the addition of solvents to achieve a solution comprised of, by approximate weight percentage, 60% MEK, 9% toluene, 12% propylene glycol mono-methyl ether acetate (1-methoxy-2-propanol, acetate) with the balance being the polyester resin. The reformulated edge sealant will therefore exhibit a viscosity within the range noted previously.

Figure 3:
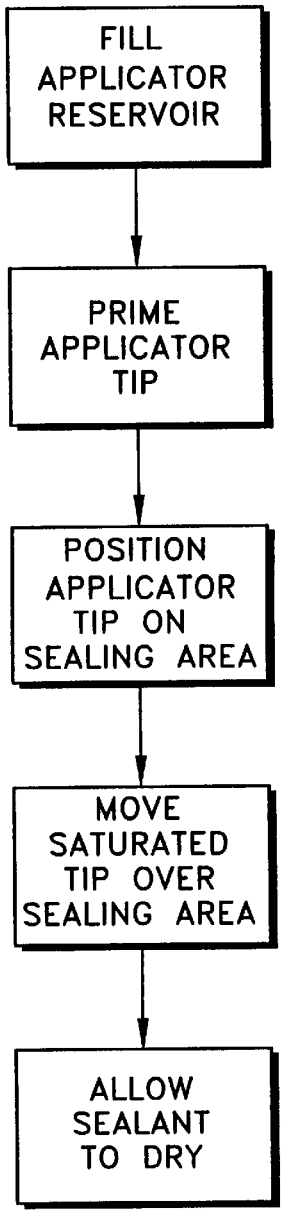
FIG. 3 is a diagrammatic representation of the exemplary steps employed to seal a window film edge in accordance with the present invention.
Figure 4:
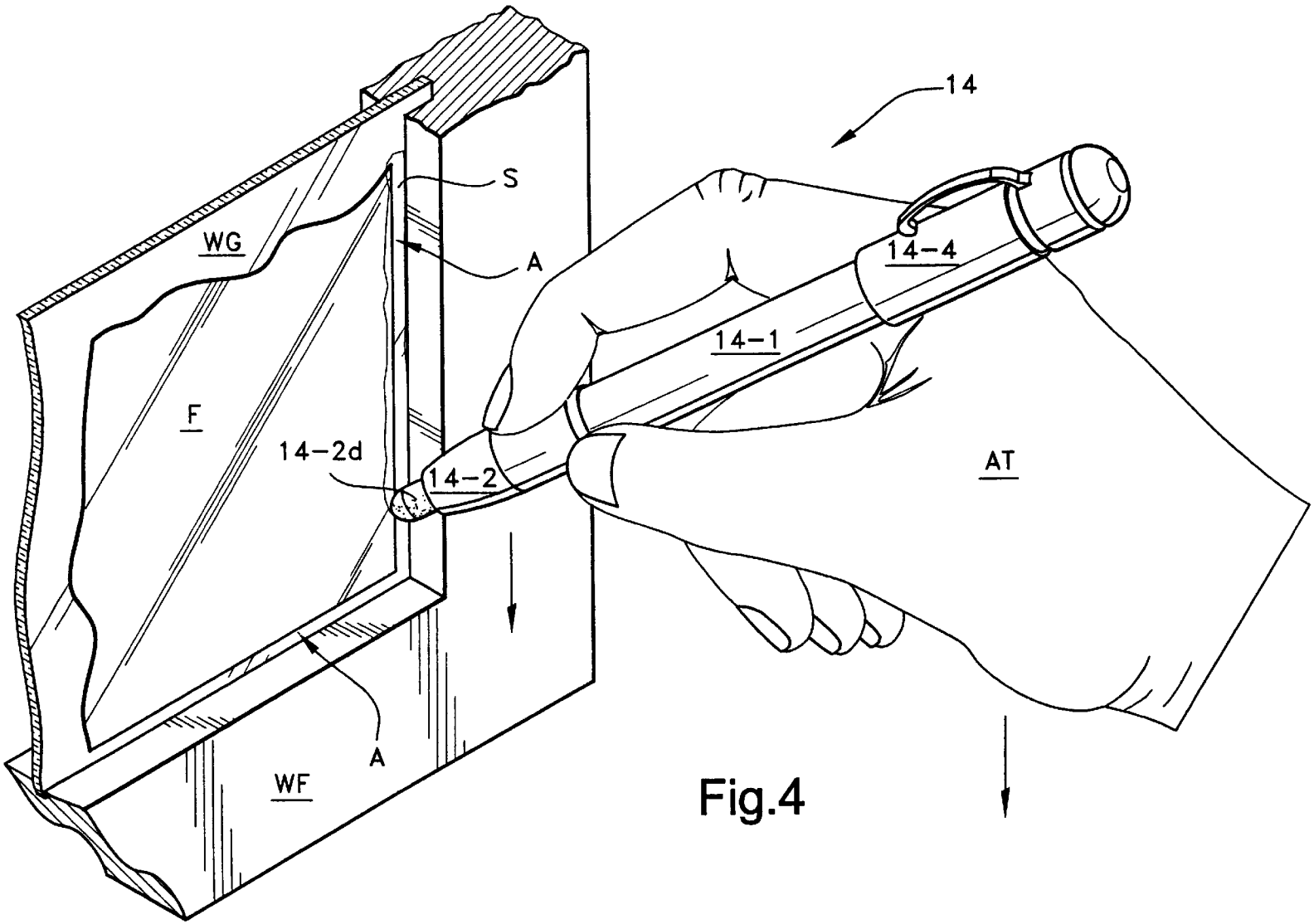
FIG. 4 is a perspective view illustrating a window film edge-sealing technique in accordance with the present invention.

In use, with reference to FIGS. 3–4, the applicator reservoir 14-1*c* of the applicator 14 is filled with a quantity of liquid edge sealant so as to provide an available stand-by supply for the applicator tip 14-2*d*. The applicator tip 14-2*d* must thereafter be primed—that is to say, saturated with the liquid sealant. The applicator tip 14-2*d* is most conveniently saturated by depressing the tip 14-2*d* (e.g., by pushing the tip 14-2*d* downwardly against a suitable rigid surface) within the housing 14-2 so as to allow the liquid sealant in the reservoir space 14-1*c* to flow by gravity to the tip 14-2*d*.

Once the applicator tip 14-2*d* has been saturated/primed (as evident by an uninterrupted flow of liquid sealant therefrom), it may be placed on the edge area A to be coated with the liquid sealant on the window glass WG so as to seal the edge of the window film F thereon (see FIG. 4). In this regard, the edge area A is a region of the window glass WG which is uncovered by, and thus borders, the window film F parallel to the adjacent window frame WF. Typically, the edge area A has a dimension less than about ¼ inch, and usually less than about ⅛ inch, as measured between the edge of the window film F and the window frame WF.

Most preferably, the tip 14-2*d* is placed at a corner of the area A (i.e., at the juncture of a horizontal and vertical section of the area A). The applicator 14 may then be moved manually along the edge area A with the applicator tip 14-2*d* in wiping contact with the exposed window glass WG and the outer edge of the window film F. In such a manner, a thin sealing layer S of the sealant material covers the edge area A of window film F so as to seal the same. In some instances, the applicator tip 14-2*d* will bridge the space between the edge of the window film WF and the opposed portion of the window frame WF. However, such bridging is not necessary in order to achieve adequate sealing of the window film edge WF.

By way of example, as shown in FIG. 4, the applicator tip 14-2*d* was placed in the upper right-hand corner (as viewed from the perspective of FIG. 4) of the window glass WG within the window frame WF. The applicator technician AT then moved the applicator tip 14-2*d* in wiping contact downwardly along the area A so as to transfer sealant material onto the area A and thereby form the sealing layer S therealong. The sealant material is allowed to dry once the sealant layer S has been applied to all areas A surrounding the window film F. The sealant layer S thus seals the edge of the window film F so as to prevent degradation by chemical cleaning agents and the like.

Any suitable window film F may be employed in the practice of the present invention. Thus, the window film may have one or more metallized layers on a thermoplastic substrate, for example, as described in U.S. Pat. Nos. 4,634,637, 4,557,980 and 4,797,317 (the entire content of each being expressly incorporated hereinto by reference).

Alternatively, or additionally, the window film may be a film dyed in accordance with U.S. Pat. Nos. 4,050,892 and 4,055,971 (the entire content of each being expressly incorporated hereinto by reference).

Thus, while the present invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of coating an edge of a window film comprising the steps of:

(a) moving a porous applicator tip saturated with liquid sealant comprised of solvent and solvated polymer in wiping contact along an edge of a window film to be sealed so as to transfer a portion of the liquid sealant from the saturated applicator tip to the window film edge; and (b) allowing the liquid sealant to dry to form a non-tacky dried edge-sealant which is resistant to disturbance or destruction by ammonia and acetic acid thereby allowing the window to be cleaned with ammonia and/or acetic acid containing cleaners.

2. The method of claim 1, wherein prior to step (a) there is practiced the step of saturating a porous applicator tip with a liquid sealant.

3. The method of claim 2, wherein said step of saturating the porous applicator tip includes (i) providing a pen-like applicator having a barrel which defines an interior reservoir space, (ii) filling the reservoir space with a quantity of liquid sealant, and (iii) bringing the applicator tip into fluid communication with the reservoir space so as to allow the liquid sealant to flow into the applicator tip and thereby saturate the same.

4. The method of claim 1, wherein the sealant is a solvated plastics material, and wherein step (b) includes allowing solvent to evaporate so as to leave a dried residue of the plastics material as a layer which seals the edge of the window film.

5. The method of claim 1, wherein the saturated applicator tip is provided as a movable component part of a pen-like applicator having a reservoir capable of holding a stand-by supply of liquid sealant, and wherein step (a) is practiced while maintaining the applicator tip in a condition whereby fluid communication is established with the liquid sealant in the reservoir.

6. The method of claim 5, wherein the pen-like applicator has a spring which biases the applicator tip between a sealed condition in which liquid sealant is prevented from flowing from the reservoir space to the applicator tip, and an open condition in which liquid sealant in said reservoir space is allowed to flow by gravity to the applicator tip, and wherein step (a) is practiced by applying sufficient pressure against the applicator tip to maintain the applicator tip in said open condition.

7. The method of claim 1, wherein the container contains a liquid sealant having a viscosity at a standard temperature of 20° C. such that a Gardner #2 Zahn Cup is emptied in between about 20 seconds to about 30 seconds.

8. The method of claim 7, wherein the liquid sealant has a viscosity at a standard temperature of 20° C. such that the Gardner #2 Zahn cup is emptied in between about 23 to about 24 seconds.

* * * * *

UNITED STATES PATENT AND TRADEMARK OFFICE

CERTIFICATE OF CORRECTION

PATENT NO. : 6,090,451
DATED : July 18, 2000
INVENTOR(S) : Steven A. Barth et al It is certified that error appears in the above-identified patent and that said Letters Patent is hereby corrected as shown below:

Title Page, Item [75], change "Debusk" to - DeBusk -

Title Page, Item [73], change "CPFfilms" to - CPFilms -

Column 1,
Line 21, change "hating" to - heating -

Column 3,
Line 58, delete "an" after the word - regard -

Signed and Sealed this

Twelfth Day of June, 2001

Nicholas P. Godici

*Attest:*

*Attesting Officer*

NICHOLAS P. GODICI
*Acting Director of the United States Patent and Trademark Office*